US006837193B2

(12) United States Patent
Kobayashi et al.

(10) Patent No.: US 6,837,193 B2
(45) Date of Patent: Jan. 4, 2005

(54) FLOW CONTROL VALVE

(75) Inventors: Masahiro Kobayashi, Obu (JP); Hirohisa Ito, Obu (JP); Daisuke Yamamoto, Obu (JP); Shigetaka Yoshikawa, Nishikamo-gun (JP); Yoshikazu Shinpo, Nissin (JP); Isao Takagi, Okazaki (JP)

(73) Assignees: Aisan Kogyo Kabushiki Kaisha, Obu (JP); Toyota Jidosha Kabushiki Kaisha, Toyota (JP)

( * ) Notice: Subject to any disclaimer, the term of this patent is extended or adjusted under 35 U.S.C. 154(b) by 17 days.

(21) Appl. No.: 10/340,743

(22) Filed: Jan. 13, 2003

(65) Prior Publication Data

US 2003/0136357 A1 Jul. 24, 2003

(30) Foreign Application Priority Data

Jan. 23, 2002 (JP) ..... 2002-013691
Dec. 10, 2002 (JP) ..... 2002-357914

(51) Int. Cl.[7] ..... F01P 7/16
(52) U.S. Cl. ..... 123/41.1; 123/41.02
(58) Field of Search ..... 123/41.02, 41.05, 123/41.08, 41.07, 41.1

(56) References Cited

U.S. PATENT DOCUMENTS 4,537,158 A * 8/1985 Saur ..... 123/41.1
5,189,991 A * 3/1993 Humburg ..... 123/41.1
6,213,060 B1 * 4/2001 Kuze ..... 123/41.1
6,314,920 B1 * 11/2001 Suzuki et al. ..... 123/41.1
6,343,573 B1 * 2/2002 Takahashi ..... 123/41.1
6,422,181 B1 * 7/2002 Ovari ..... 123/41.1
6,460,492 B1 * 10/2002 Black et al. ..... 123/41.1
6,679,202 B2 * 1/2004 Nakano ..... 123/41.1
6,688,333 B2 * 2/2004 McLane et al. ..... 137/625.11

FOREIGN PATENT DOCUMENTS

JP A 9-195768 7/1997
JP A 2000-18039 1/2000

* cited by examiner

*Primary Examiner*—Henry C. Yuen
*Assistant Examiner*—Jason Benton
(74) *Attorney, Agent, or Firm*—Oliff & Berridge, PLC

(57) ABSTRACT

A flow control valve used in a cooling system of a water cooling type includes a first valve body and a first valve seat for controlling a quantity of radiator flow which returns from an engine to a pump through a radiator, a second valve body and a second valve seat for controlling a quantity of bypass flow which returns from the engine to the pump without passing through the radiator, and a step motor for displacing the valve bodies integrally as a valve unit. The first valve body, the first valve seat, the second valve body, and the second valve seat are so arranged that, in a range where the radiator flow quantity becomes practically zero, the bypass flow is permitted to flow at a slightly larger quantity than the radiator flow and, in other ranges, the bypass flow quantity is equal to or lower than the radiator flow quantity.

12 Claims, 10 Drawing Sheets

FLOW CONTROL VALVE

BACKGROUND OF THE INVENTION

1. Field of the Invention

The present invention relates to a flow control valve which is provided in a cooling system for cooling an engine by circulating cooling water through the engine and which is used for controlling a flow quantity of the cooling water.

2. Description of Related Art

Cooling systems of a water cooling type conventionally used in engines have generally been arranged to control cooling water at a constant temperature of about 80° C. by means of a thermostat without reference to an operating state of the target engine. However, changing a cooling degree of an engine according to an operating state (a loaded condition, a rotational speed, etc.) of the engine was found to be effective in reducing friction of the engine, improving fuel efficiency, enhancing knocking performance, and preventing the overheating of the cooling water. Accordingly, there have been proposed several types of cooling systems using cooling water each arranged to control a cooling degree of an engine according to an operating state of the engine.

Such cooling systems of engines are disclosed in Japanese patent unexamined publications Nos. 09(1997)-195768 and 2000-18039. The cooling system disclosed in the JP unexamined publication No. 09(1997)-195768 is provided with a flow control valve including a first valve body and a first valve seat for controlling a flow quantity of the cooling water which flows out of an engine and returns to a water pump by way of a radiator (hereinafter referred to as a "radiator flow quantity"), a second valve body and a second valve seat for controlling a flow quantity of the cooling water which flows out of the engine and bypass the radiator to directly return to the water pump (hereinafter referred to as a "bypass flow quantity"), and an electromagnetic actuator which drives the first and second valve bodies integrally as a valve unit. The above electromagnetic actuator is constructed of an electromagnetic coil which attracts a shaft made of a magnetic material when electric current is applied to the coil, thereby displacing the shaft downward against the force of a spring. Upon stop of the application of electric current to the coil, on the other hand, the shaft is displaced upward by the force of the spring. In association with the shaft displacement, the first and second valve bodies are driven together as a valve unit.

Similar to the above cooling system disclosed in JP unexamined publication No. 9(1997)-195768, the cooling system disclosed in JP unexamined publication No. 2000-18039 is provided with a radiator circuit for permitting cooling water which flows out of an engine to circulate through a radiator and a bypass circuit for permitting the cooling water which flows out of the engine to bypass the radiator to flow back to the engine. In a portion at which the bypass circuit and the radiator circuit meet, there is disposed a rotary flow control valve for controlling a flow quantity (the radiator flow quantity) of the cooling water flowing in the radiator circuit and a flow quantity (the bypass flow quantity) of the cooling water flowing in the bypass circuit. This flow control valve includes a rotary valve having a cup shape rotatably provided in a housing. This flow control valve is constructed to measure the radiator flow quantity and the bypass flow quantity at an outer periphery of the rotary valve and cause the cooling water flowing in the radiator circuit and the bypass circuit to flow together to return to the engine through a pump.

And now, in the above flow control valve disclosed in JP unexamined publication No. 9(1997)-195768, at the time of driving the valve by operation of the electromagnetic actuator, this actuator is required to produce a driving torque enough to overcome the force of the spring, the force of pressure of the cooling water, and the force caused by collision of the cooling water with each valve. The first valve body is acted upon by the pressure of fluid at an inlet port of the flow control valve (namely, a radiator flow inlet pressure), while the second valve body is acted upon by the pressure of fluid at another inlet port of the flow control valve (namely, a bypass flow inlet pressure). Thus, a difference between those two pressures acts on a valve unit. If the pressure difference is large, the thrust corresponding to the difference is applied to the valve and therefore the electromagnetic actuator is requested to produce a large driving torque. In general, the diameter of a passage for the bypass flow (hereinafter referred to as a "bypass passage") is smaller than that of a passage for the radiator flow (hereinafter referred to as a "radiator passage"). When the bypass flow quantity becomes larger than the radiator flow quantity, the pressure in the bypass passage becomes a negative pressure, resulting in a large influence on a pressure characteristic. Accordingly, bypass flow inlet pressure is largely reduced depending on a bypass flow quantity characteristic, thereby increasing the pressure difference mentioned above. As a result, the electromagnetic actuator is required to produce a large driving torque to open the flow control valve against the thrust resulting from the pressure difference. This leads to a need to upsize the actuator, which may cause problems of a deterioration in mountability of the flow control valve with respect to the engine and an increase in manufacturing cost of the flow control valve.

In the flow control valve disclosed in JP unexamined publication No. 2000-18039, on the other hand, there is a need to measure the radiator flow quantity and the bypass flow quantity at the outer periphery of the rotary valve. Furthermore, many cooling systems currently used adopt "an internal bypass type" which is provided with a bypass circuit in the inside of an engine block to flow cooling water through the bypass circuit. Accordingly, the flow control valve disclosed in JP unexamined publication 2000-18039 could not directly be used in the internal bypass type of cooling system. To adopt the flow control valve, there is a need to change the shape of the engine or to additionally provide a bypass pipe to the outside of the engine block. Consequently, the cost of manufacturing the cooling system would be increased extremely.

SUMMARY OF THE INVENTION

The present invention has been made in view of the above circumstances and has a first object to overcome the above problems and to provide a flow control valve capable of preventing the thrust which acts on the valve due to a difference between a radiator flow pressure and a bypass flow pressure to relatively reduce the driving torque which an actuator is requested to produce, thereby achieving downsizing of an actuator.

In addition to the first object, a second object of the present invention is providing a flow control valve which can simply, inexpensively be mounted in an engine.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a flow control valve which is used in a cooling system of a water cooling type for cooling an engine by circulating cooling water by a water pump and radiating heat of the cooling water by a radiator; the cooling system including a cooling water passage provided in the engine, a radiator flow passage for permitting the cooling water flowing out of the cooling water passage to return to the water pump through the radiator, a bypass flow passage for permitting the cooling water flowing out of the cooling water passage to directly return to the water pump without passing through the radiator, and an electronic control device for controlling the flow control valve, the radiator flow passage and the bypass flow passage being connected to the flow control valve at a position upstream from the water pump; the flow control valve including a first valve body and a first valve seat for controlling a radiator flow quantity corresponding to a flow quantity of the cooling water flowing in the radiator passage, a second valve body and a second valve seat for controlling a bypass flow quantity corresponding to a flow quantity of the cooling water flowing in the bypass passage, and an actuator for displacing the first and second valve bodies integrally as one valve; the electronic control device for controlling the actuator to displace the valve, thereby regulating the radiator flow quantity and the bypass flow quantity to control a temperature of the cooling water to a target temperature; the radiator flow quantity and the bypass flow quantity are defined in terms of ranges in relation to the displacement amount of the valve so that each structure of the first valve body and the first valve seat and each structure of the second valve body and the second valve seat are determined to have a flow quantity characteristic that the bypass flow quantity is slightly larger than the radiator flow quantity in a range where the radiator flow quantity becomes practically zero and, in other ranges, the bypass flow quantity is equal to or lower than the radiator flow quantity.

According to another aspect of the present invention, there is provided a flow control valve which is used in a cooling system of a water cooling type for cooling an engine by circulating cooling water by a water pump and radiating heat of the cooling water by a radiator; the cooling system including a cooling water passage provided in the engine, a radiator flow passage for permitting the cooling water flowing out of the cooling water passage to return to the water pump through the radiator, a bypass flow passage for permitting the cooling water flowing out of the cooling water passage to directly return to the water pump without passing through the radiator, and an electronic control device for controlling the flow control valve, the radiator flow passage and the bypass flow passage being connected to the flow control valve at a position upstream from the water pump; the flow control valve including a first valve body and a first valve seat for controlling a radiator flow quantity corresponding to a flow quantity of the cooling water flowing in the radiator passage, a second valve body and a second valve seat for controlling a bypass flow quantity corresponding to a flow quantity of the cooling water flowing in the bypass passage, and an actuator for displacing the first and second valve bodies integrally as one valve; the electronic control device for controlling the actuator to displace the valve, thereby regulating the radiator flow quantity and the bypass flow quantity to control a temperature of the cooling water to a target temperature; the radiator flow quantity and the bypass flow quantity are defined in terms of ranges in relation to the displacement amount of the valve so that each structure of the first valve body and the first valve seat and each structure of the second valve body and the second valve seat are determined to have a flow quantity characteristic that the radiator flow quantity increases with respect to an increase of displacement amount of the valve while the bypass flow quantity increases and decreases with respect to the increase of displacement amount of the valve, the bypass flow quantity is slightly larger than the radiator flow quantity in a range where the radiator flow quantity becomes practically zero and, in other ranges, the bypass flow quantity is equal to or lower than the radiator flow quantity.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

[First Embodiment]

A detailed description of a first preferred embodiment of a flow control valve embodying the present invention will now be given referring to the accompanying drawings.

Figure 1:
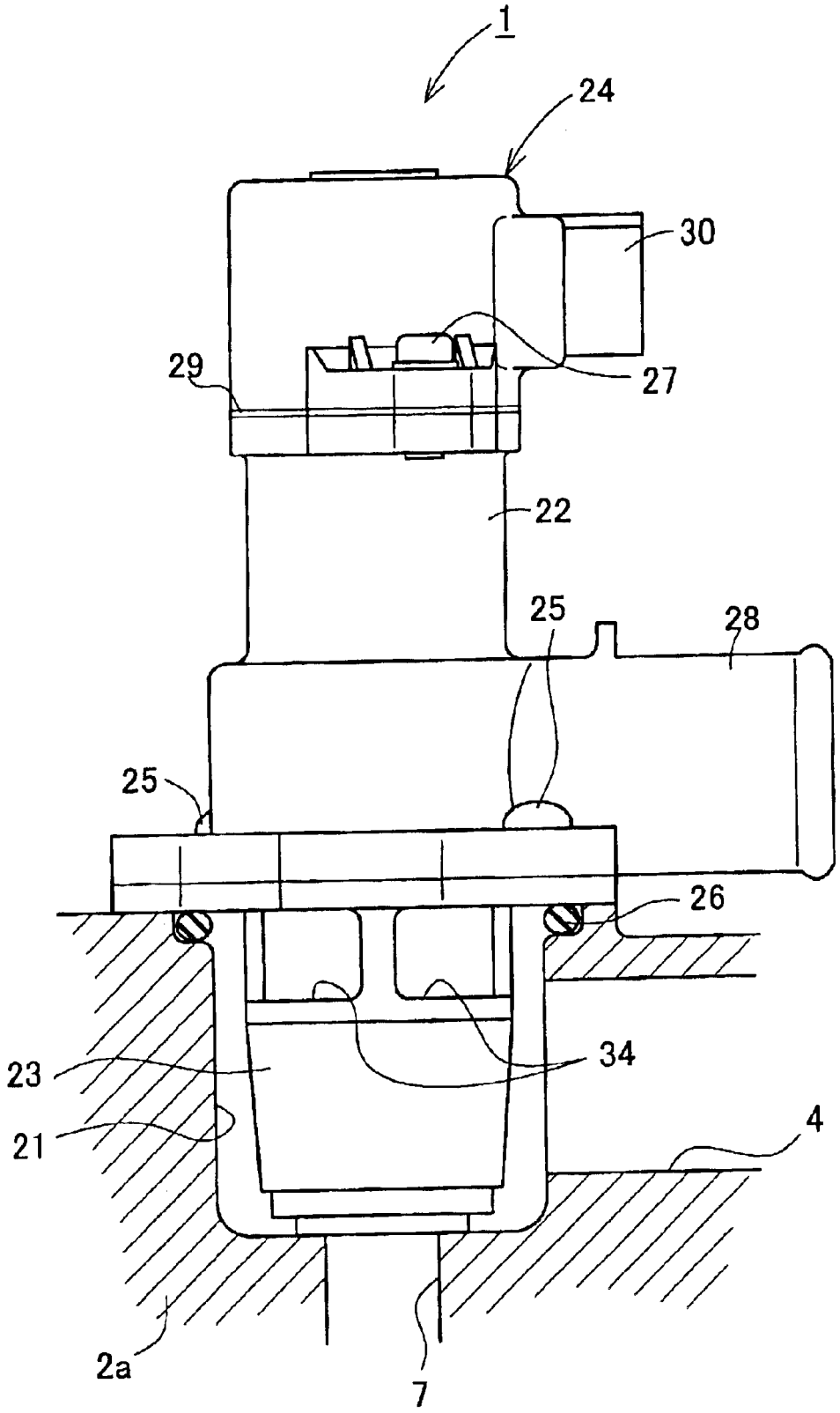
FIG. 1 is a side view of a flow control valve in a first embodiment according to the present invention.
Figure 2:
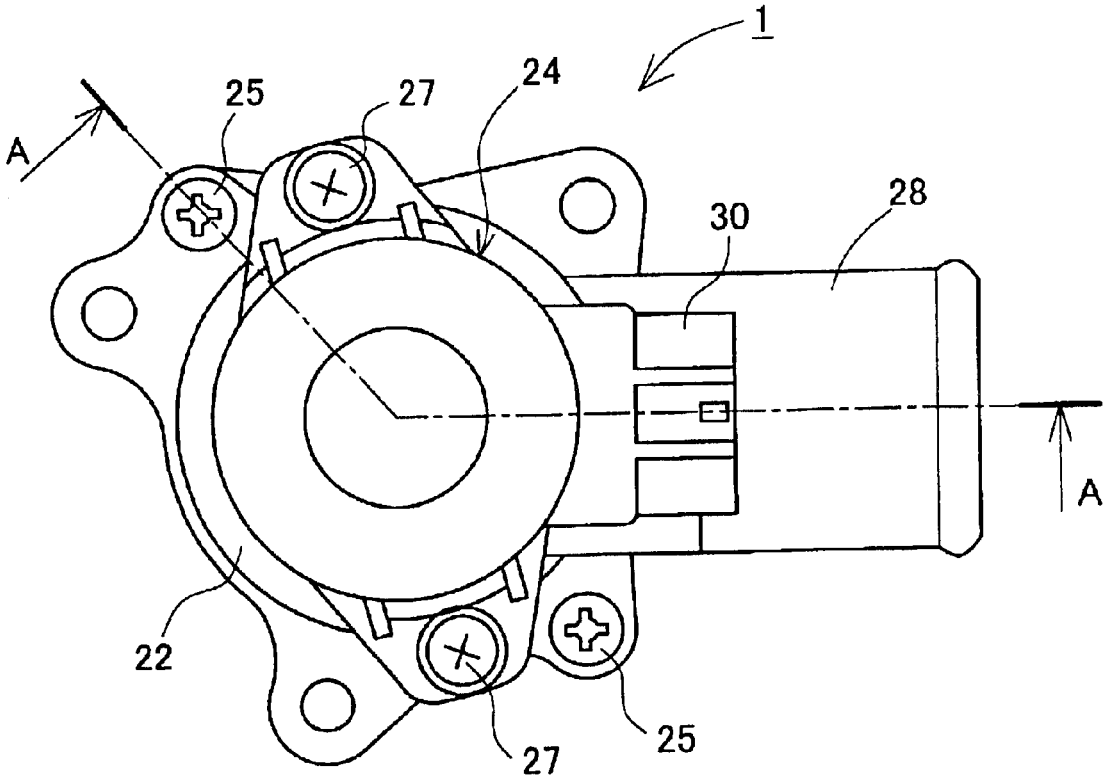
FIG. 2 is a plane view of the flow control valve of FIG. 1.
Figure 3:
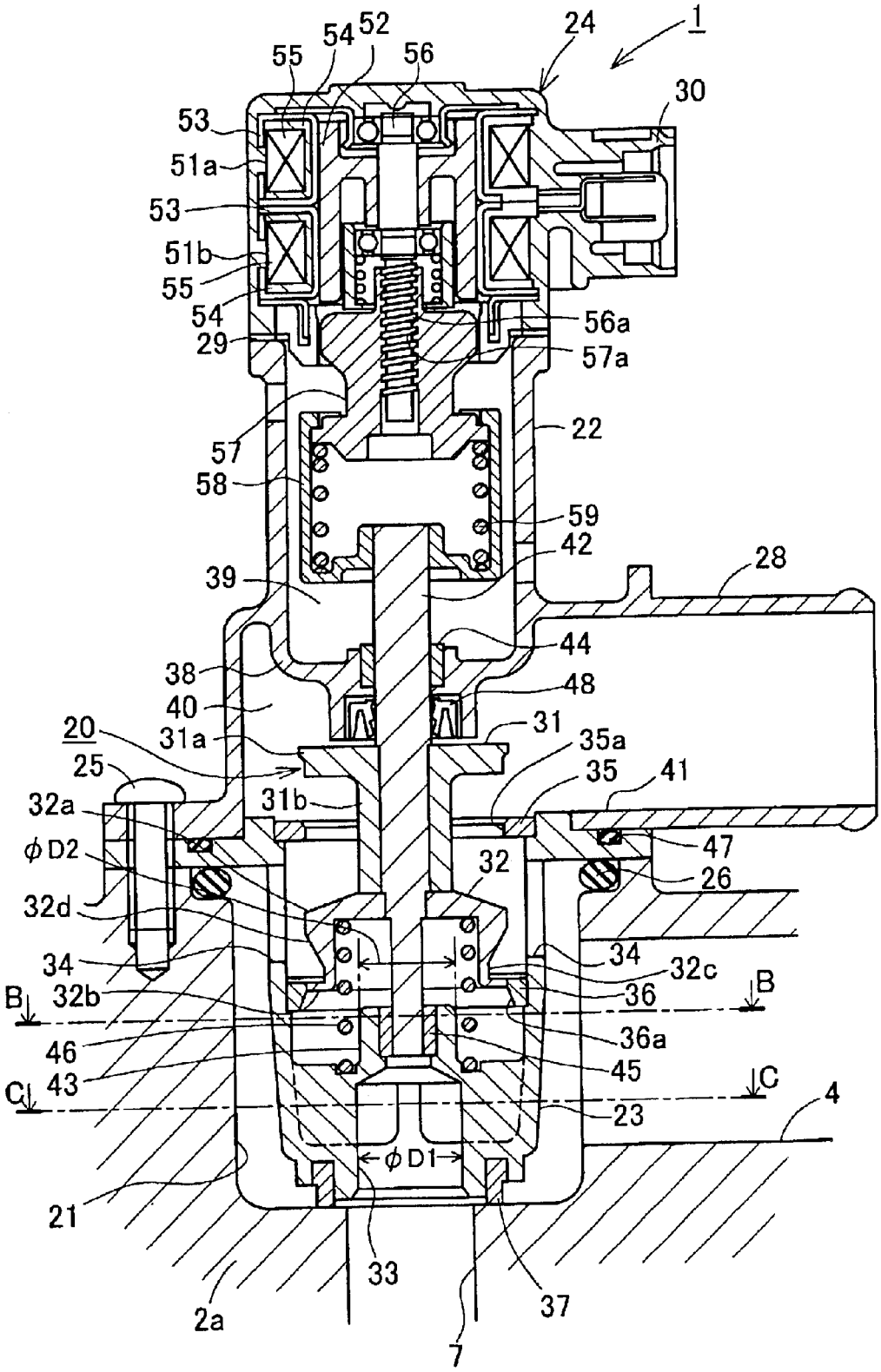
FIG. 3 is a longitudinal sectional view of the flow control valve taken along a line A—A in FIG. 2.
Figure 4:
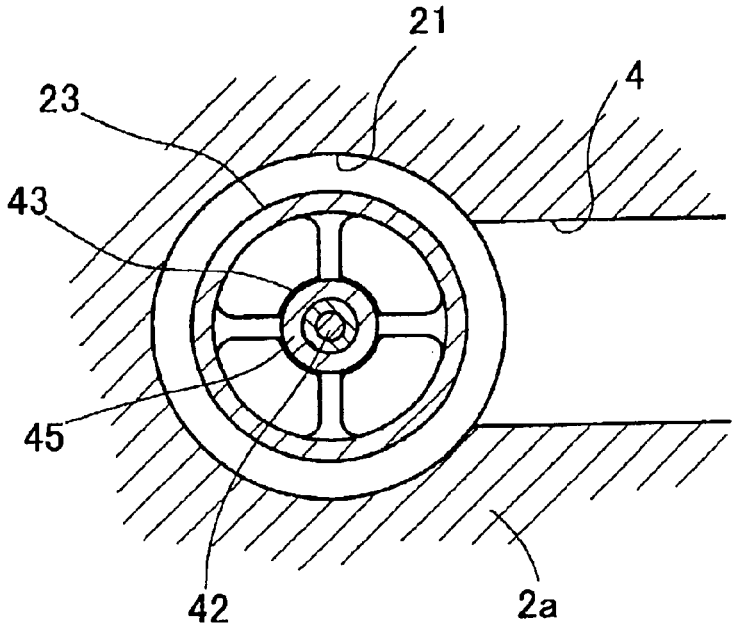
FIG. 4 is a cross sectional view of the flow control valve taken along a line B—B in FIG. 3.
Figure 5:
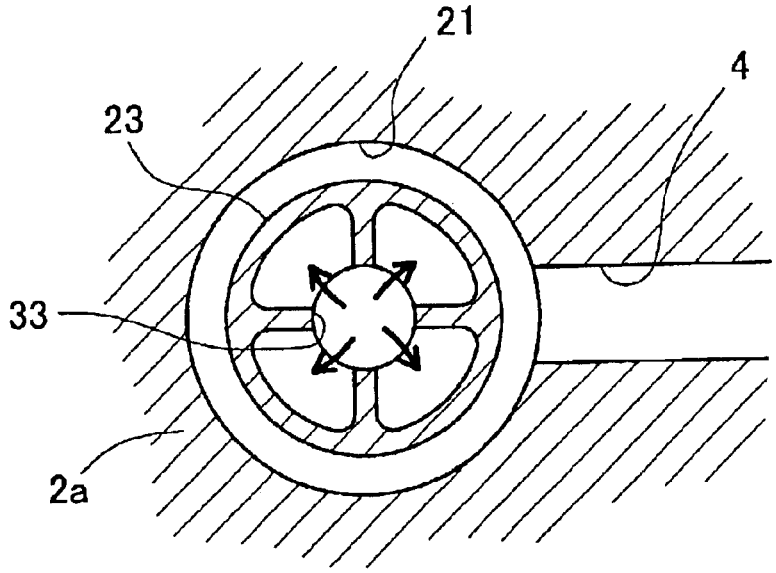
FIG. 5 is a cross sectional view of the flow control valve taken along a line C—C in FIG. 3.

FIG. 1 is a side view of the flow control valve in the first embodiment. FIG. 2 is a plane view of the valve in FIG. 1. FIG. 3 is a longitudinal sectional view of the valve taken along a line A—A in FIG. 2. FIG. 4 is a cross sectional view of the valve taken along a line B—B in FIG. 3. FIG. 5 is a cross sectional view of the valve taken along a line C—C in FIG. 3. Arrows in FIG. 5 indicate the flow of water.

Figure 6:
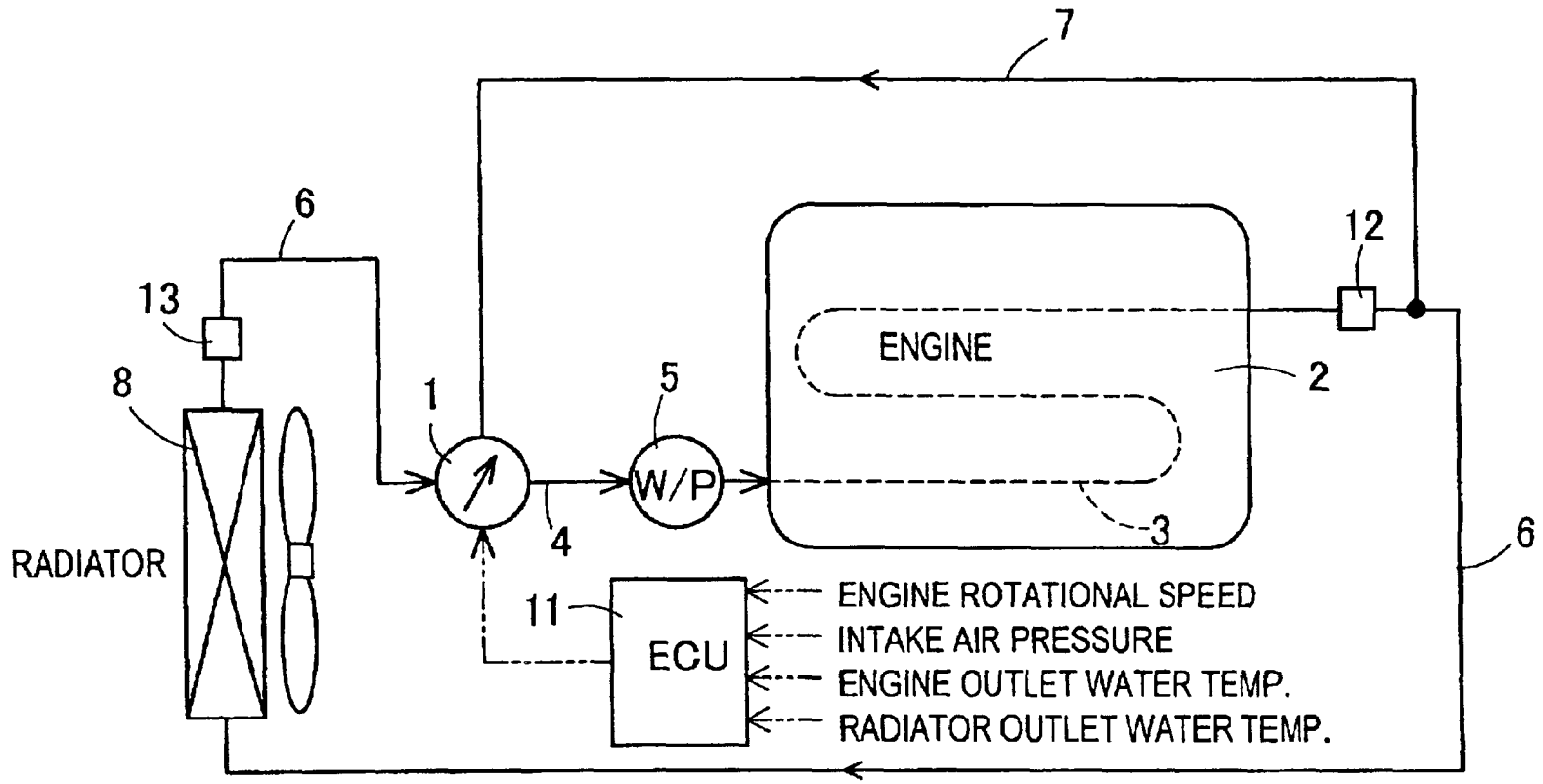
FIG. 6 is a schematic structural view of an engine cooling system.

The flow control valve 1, which is integrated in a cooling system of a water-cooled engine used for automobiles, is used to control a flow quantity of cooling water. FIG. 6 is a schematic structural view of the cooling system. In FIG. 6, an engine 2 is internally provided with a cooling water passage 3 including a water jacket and others. An outlet port of the flow control valve 1 is connected to a water pump (W/P) 5 through a pump passage 4. The water pump 5 is connected to an inlet of the cooling water passage 3. An outlet of this passage 3 is connected to a radiator passage 6 and a bypass passage 7. The radiator passage 6 is connected to the flow control valve 1 via a radiator 8. The bypass passage 7 is directly connected to the valve 1, not via the radiator 8.

In an open state of the flow control valve 1, when the water pump 5 is actuated in conjunction with operation of the engine 2, the pump 5 discharges cooling water into the cooling water passage 3 of the engine 2. The cooling water circulates through the engine 2 and then flows out from the outlet of the passage 3. A part of the cooling water flowing out of the passage 3 flows into the valve 1 through the radiator passage 6 and the radiator 8, while a part of the cooling water flowing out of the passage 3 flows into the valve 1 through the bypass passage 7. The valve 1 controls a radiator flow quantity of the cooling water flowing from the radiator passage 6 into the valve 1 and a bypass flow quantity of the cooling water flowing from the bypass passage 7 into the valve 1. The cooling water of a controlled flow quantity is then delivered to the water pump 5 through the pump passage 4 and discharged again into the cooling water passage 3. This circulation of the cooling water cools the engine 2 at suitable temperatures.

By the above control of the radiator flow quantity by the flow control valve 1, the temperature of the cooling water flowing through the passage 3 of the engine 2 is controlled. Specifically, when the radiator flow quantity is controlled by the flow control valve 1 to increase, the ratio of the cooling water having radiated heat through the radiator 8 in the cooling water flowing through the passage 3 increases. Accordingly, the temperature of the cooling water which cools the engine 2 becomes relatively lower. When the radiator flow quantity is controlled by the flow control valve 1 to decrease, on the other hand, the ratio of the cooling water having radiated heat through the radiator 8 in the cooling water flowing through the passage 3 decreases. Due to this, the temperature of the cooling water contributing to cooling of the engine 2 becomes relatively higher.

The flow control valve 1 is connected to an electronic control unit (ECU) 11 for controlling the engine 2 as shown in FIG. 6. The ECU 11 controls the valve 1 to adjust the degree of cooling the engine 2 in response to an operating state of the engine 2. For execution of control to open/close the valve 1, the ECU 11 receives signals representing parameters such as an engine rotational speed, an intake air pressure, an engine outlet water temperature, and a radiator outlet water temperature, from various sensors. The engine outlet water temperature of the above parameters is the temperature of cooling water detected by a first water temperature sensor 12 disposed close to the outlet of the cooling water passage 3. The radiator outlet water temperature is the temperature of cooling water detected by a second water temperature sensor 13 disposed close to the outlet of the radiator 8. The ECU 11 controls the opening and closing (an opening degree) of the valve 1 in response to the operating state of the engine 2 based on the signals representing the various parameters.

As shown in FIG. 1, the flow control valve 1 is mounted in a thermostat housing 21 formed in a block 2*a* of the engine 2 (hereinafter simply referred to as an "engine block"). The housing 21 is communicated with the pump passage 4 and the bypass passage 7 respectively. The pump passage 4 is communicated with the water pump 5. The housing 21 is generally used to hold a well known thermostat. In the present embodiment, however, the housing 21 is used to mount therein the flow control valve 1.

More specifically, the engine block 2*a* of the engine 2 includes the housing 21 for mounting the thermostat, the pump passage 4 for permitting cooling water to flow into the water pump 5 from the housing 21, and the bypass passage 7 for permitting cooling water that returns to the water pump 5 without passing through the radiator 8 to flow into the housing 21. This housing 21 is utilized to mount therein the flow control valve 1.

As shown in FIGS. 1 and 2, the flow control valve 1 is constructed of three sections including a first body 22, a second body 23 serving as a joint body of the present invention, and a step motor 24 serving as an actuator of the present invention. The second body 23 is designed to have the outer diameter relatively smaller than the inner diameter of the housing 21 and the height equal to the depth of the housing 21. This dimensional design permits the second body 23 to be received and mounted in the housing 21. In this mounted state, the first and second bodies 22 and 23 are both secured to the engine block 2*a* with screws 25. A seal ring 26 is provided between the first body 22 and the engine block 2*a*. The step motor 24 is secured to the first body 22 with screws 27. The first body 22 is provided with a joint pipe 28 which is connected to the radiator passage 6. Between the step motor 24 and the first body 22, there is sandwiched a shim 29 for adjustment of valve opening steps. A wiring connector 30 is provided in the step motor 24.

As described above, the flow control valve 1 controls the radiator flow quantity of the cooling water which flows out of the cooling water passage 3 of the engine 2 and returns to the water pump 5 through the radiator passage 6 and the radiator 8 and simultaneously controls the bypass flow quantity of the cooling water which flows out of the passage 3 and returns to the water pump 5 without passing through the radiator 8. The valve 1 is provided, as shown in FIG. 3, with a first valve body 31 and a first valve seat 35 for controlling the radiator flow quantity and a second valve body 32 and a second valve seat 36 for controlling the bypass flow quantity. These first and second valve bodies 31 and 32 are configured so as to be driven and displaced integrally as one valve unit 20 by the step motor 24.

As shown in FIG. 3, the second body 23 having a cylindrical shape is formed with a bypass port 33 in the lower portion. This bypass port 33 is communicated with the bypass passage 7. The body 23 is also formed with a pump port 34 in the upper portion. In the body 23, the first valve seat 35 to be used for the first valve body 31 and the second valve seat 36 to be used for the second valve body 32 are disposed on the upper and lower sides of the pump port 34. The bypass port 33 can be communicated with the pump port 34 through a valve opening 36*a* of the second valve seat 36. A seal ring 37 for sealing a gap between the bypass passage 7 and the thermostat housing 21 is disposed in the lower portion of the body 23. The first body 22 is divided into an upper and lower chambers 39 and 40 by a partition wall 38. A valve shaft 42 is provided penetrating the partition wall 38. The lower chamber 40 is communicated with a radiator port 41 in the joint pipe 28. This radiator port 41 can be communicated with the pump port 34 through a valve opening 35*a* of the first valve seat 35.

As shown in FIG. 3, a back spring 46 is disposed between the second valve body 32 and a boss 43. This back spring 46 presses the second valve body 32 as well as the first valve body 31 by a predetermined urging force to urge the first valve body 31 in an opening direction. In the present embodiment, the output power (thrust) of the step motor 24 is minimized, so that the urging force of the back spring 46 can be determined at a minimum.

An O-ring 47 is disposed between the first and second bodies 22 and 23 for sealing a gap therebetween. A seal member 48 is provided in the first body 22 to seal a gap between the partition wall 38 and the valve shaft 42. Thus, this seal member 48 serves to prevent the cooling water flowing in the lower chamber 40 of the first body 22 from entering the upper chamber 39 communicated with the step motor 24.

In the cooling system including the flow control valve 1 in the present embodiment, as shown in FIG. 3, the bypass passage 7 and the bypass port 33 each have the inner diameter smaller than each inner diameter of the radiator passage 6 and the radiator port 41 as in the case of generally used valves. Accordingly, when the bypass flow quantity is larger than the radiator flow quantity, a pressure drop in the bypass passage 7 at the bypass port 33 becomes larger than that in the radiator passage 6 at the radiator port 41. As a result, a difference is generated between pressures which are exerted on the first and second valve bodies 31 and 32 respectively, thus producing a force acting on the valve bodies 31 and 32 in a closing direction. This results in a large influence on the pressure characteristic. More specifically, the influence of the pressure of the cooling water acting on the valve 20 of the flow control valve 1 becomes more significant when the bypass flow quantity is changed as compared with the case where the radiator flow quantity is changed. In the present embodiment, the inner diameter D1 of the bypass port 33 is determined to be larger than the outer diameter D2 of the boss 43.

Figure 7:
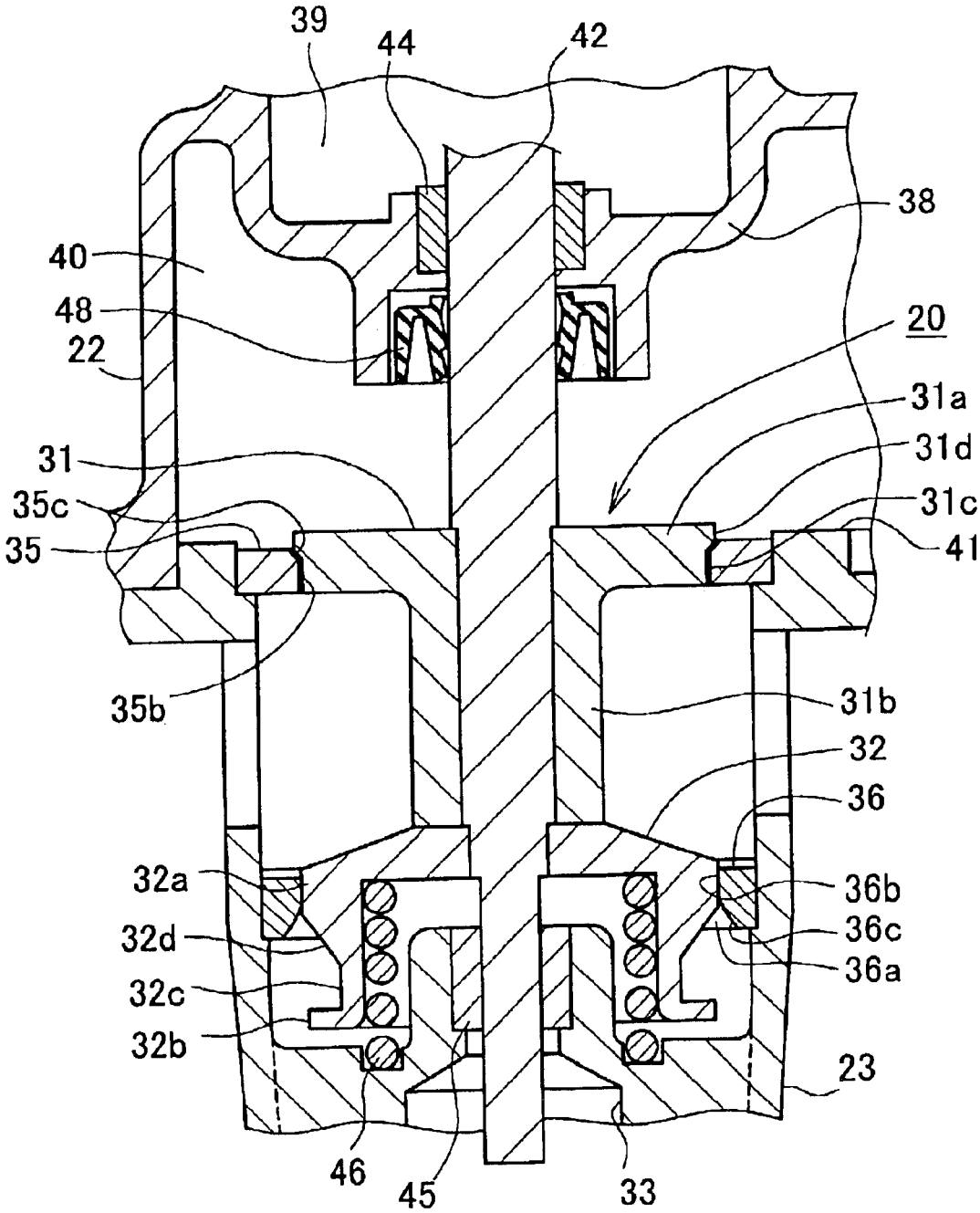
FIG. 7 is an enlarged sectional view showing a first and a second valve bodies and others of the valve in the first embodiment to explain motions of those elements.
Figure 8:
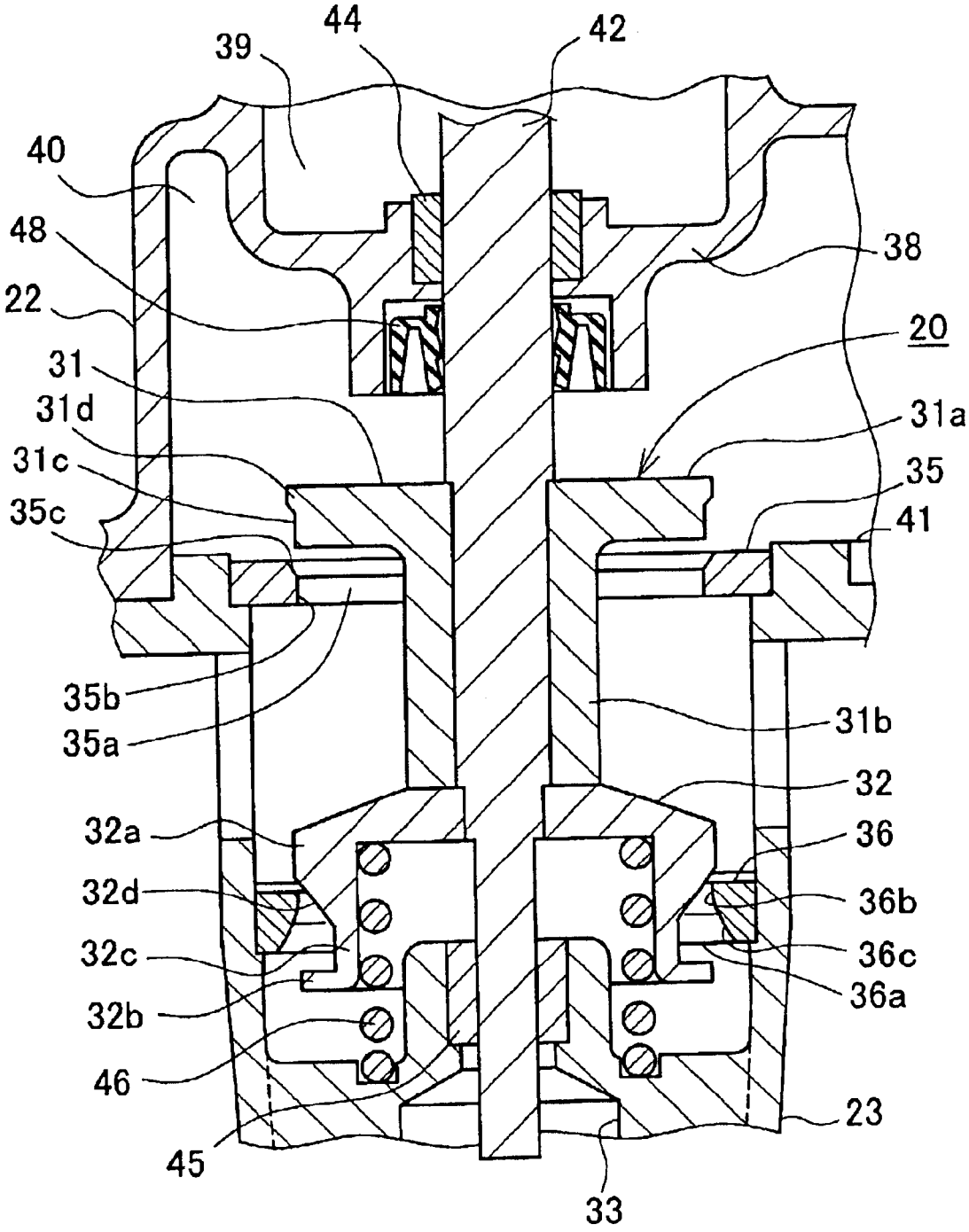
FIG. 8 is an enlarged sectional view showing the first and the second valve bodies and others to explain motions of those elements.
Figure 9:
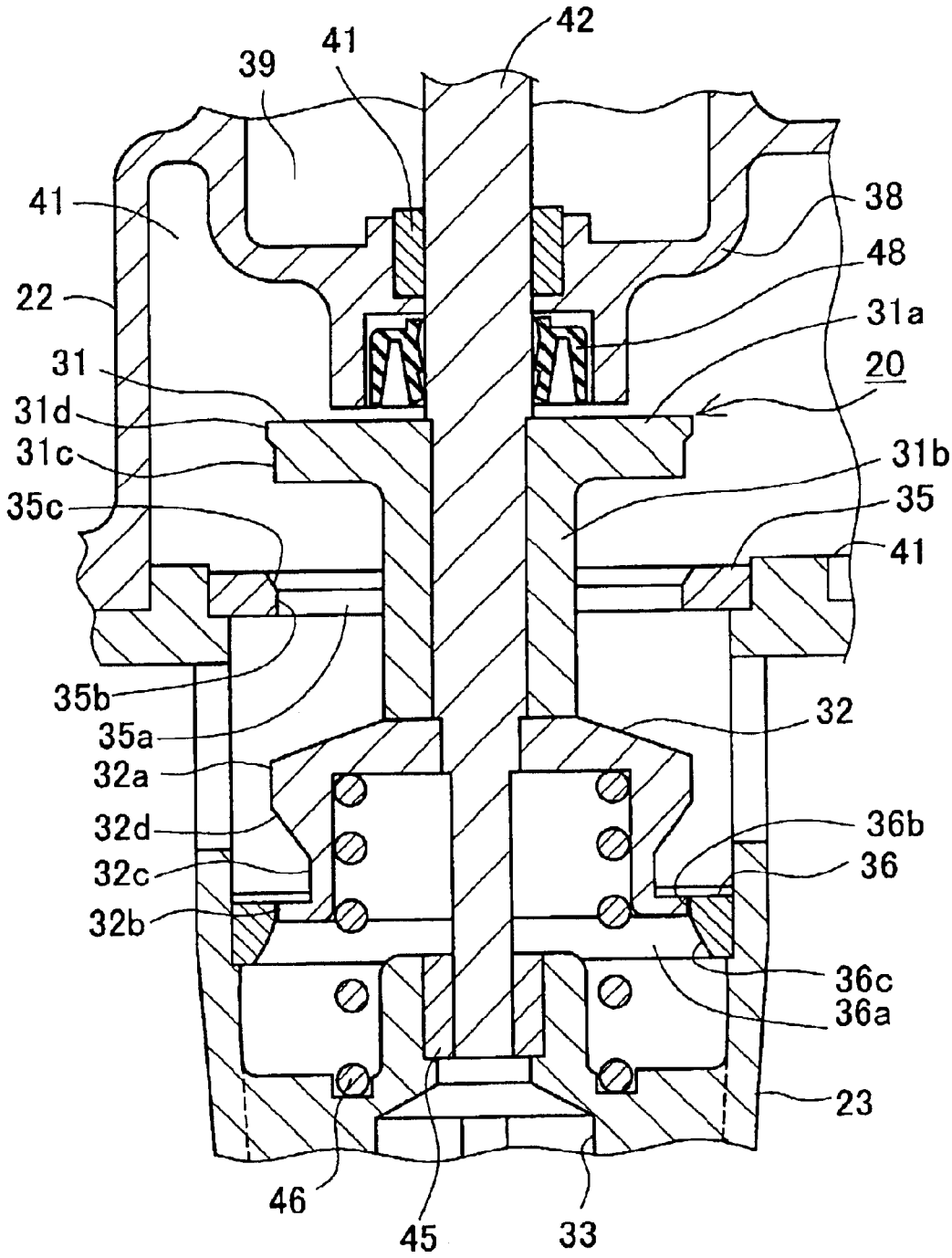
FIG. 9 is an enlarged sectional view showing the first and the second valve bodies and others to explain motions of those elements.

Next, detailed explanations are made on each structure of the first valve body 31 and the first valve seat 35 and each structure of the second valve body 32 and the second valve seat 36. FIGS. 7 to 9 show enlarged views of the first and second valve bodies 31 and 32 and others to explain motions thereof.

As shown in FIGS. 3 and 7 to 9, the first and second valve bodies 31 and 32 are fixed one above the other on the single valve shaft 42, thus constituting the valve unit 20. The valve shaft 42 is held in the partition wall 38 and the boss 43 of the second body 23 through bearings 44 and 45 so that the shaft 42 is movable in a thrust direction (in a vertical direction in FIG. 3).

The first valve body 31 having a cylindrical shape is mounted on the valve shaft 42. The first valve body 31 is constituted of a flange-shaped measuring part 31*a* formed in the upper portion and a cylindrical maximum flow quantity limiting part 31*b* formed under the measuring part 31*a*. The measuring part 31*a* is conformable to (can be engaged in) the valve opening 35*a* of the first valve seat 35. To be specific, the measuring part 31*a* includes a cylindrical part 31*c* and a large-diameter part 31*d* having the outer diameter larger than that of the cylindrical part 31*c*. The valve opening 35*a* of the first valve seat 35 includes a circumferential part 35*b* whose surface conforms to the outer surface of the cylindrical part 31*c* and a tapered part 35*c* whose surface conforms to the outer surface of the large-diameter part 31*d*. It is to be noted that the circumferential part 35*b* serves as a first sealing part and the tapered part 35*c* serves as a second sealing part. When the first valve body 31 is moved up and down integrally with the valve shaft 42, a valve opening degree for the radiator flow (hereinafter referred to as a "radiator-side opening degree") defined by a clearance between the first valve body 31 and the first valve seat 35 is changed. FIGS. 3 and 9 show the valve 20 in a full open state for the radiator-side opening degree. As the first valve body 31 is moved downward from this full open state shown in FIGS. 3 and 9 to a full closed state, the radiator-side opening degree is reduced.

The second valve body 32 placed under the first valve body 31 has a cylindrical shape of the outer diameter substantially equal to that of the measuring part 31*a* of the first valve body 31. This valve body 32 is constructed of an upper measuring part 32*a* and a lower measuring part 32*b* positioned one above the other, a maximum flow quantity limiting part 32*c* formed between the upper and lower measuring parts 32*a* and 32*b*, and a tapered part 32*d* serving as a flow quantity changing part positioned between the upper measuring part 32*a* and the maximum flow quantity limiting part 32*c*. Those upper and lower measuring parts 32*a* and 32*b* can be individually engaged in a valve opening 36*a* of the second valve seat 36. This valve opening 36*a* includes a circumferential part 36*b* whose surface conforms to each outer surface of the upper and lower measuring parts 32*a* and 32*b* and a tapered part 36*c* formed under the circumferential part 36*b*. When the second valve body 32 is moved as a unit with the first valve body 31 and the valve shaft 42, a valve opening degree for the bypass flow (hereinafter referred to as a "bypass-side opening degree") which is defined by a clearance between each of the upper and lower measuring parts 32*a* and 32*b* of the second valve body 32 and the second valve seat 36 is changed. FIGS. 3 and 9 show the valve 20 in a state where the lower measuring part 32*b* is engaged in the circumferential part 36*b*, thereby closing the second valve seat 36. As the second valve body 32 is moved downward from this state, the lower measuring part 32*b* is gradually moved away from the circumferential part 36*b*, the maximum flow quantity limiting part 32*c* comes through the circumferential part 36*b*, and then the upper measuring part 32*a* gradually comes close to the circumferential part 36*b*. Thus, the bypass-side opening degree is increased from a full closed state to a full open state and then decreased to return to the full closed state again.

The structure of the step motor 24 is explained below. As shown in FIG. 3, the step motor 24 is provided with two stators 51*a* and 51*b* and a rotor 52 disposed inside of those stators 51*a* and 51*b*. Each of the stators 51*a* and 51*b* includes a core 53 having triangular teeth arranged alternately extending from above and below and a bobbin 54 disposed in the core 53, and a coil 55. The coils 55 of the stators 51*a* and 51*b* are wound onto the corresponding bobbins 54 in opposite winding directions to each other. Accordingly, when the application of electric current to either one of the two coils 55 is switched to the other one, the direction of a magnetic pole exciting the core 53 can be changed. The two stators 51*a* and 51*b* are fixedly placed one above the other with their cores 53 positioned in disagreement with each other.

In the present embodiment, the rotor 52 is a magnet whose outer periphery is previously magnetized in the north pole and the south pole alternately. As shown in FIG. 3, a center shaft 56 is centrally disposed in the rotor 52 so that the shaft 56 is rotatable together with the rotor 52. A guide 57 is attached to the lower part of the center shaft 56 formed with a male screw 56*a* on the outer periphery. The guide 57 is formed with a female screw 57*a* which engages with the male screw 56*a* of the center shaft 56. With this structure, the rotation of the rotor 52 is converted into the movement of the guide 57 in the thrust direction through the center shaft 56. The guide 57 is connected to the valve shaft 42 through a joint 58. Between the guide 57 and the joint 58, a relief spring 59 is disposed.

The following explanation is made on the flow quantity characteristic of the flow control valve 1, which results from the structures of the first valve body 31 and the first valve seat 35 and those of the second valve body 32 and the second valve seat 36.

Figure 10A:
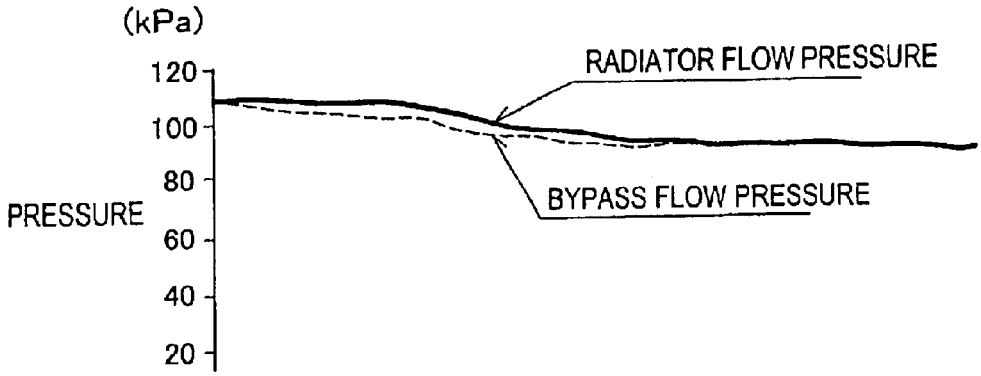
FIGS. 10A and 10B are graphs showing a flow quantity characteristic and a pressure characteristic of the flow control valve, respectively.
Figure 10B:
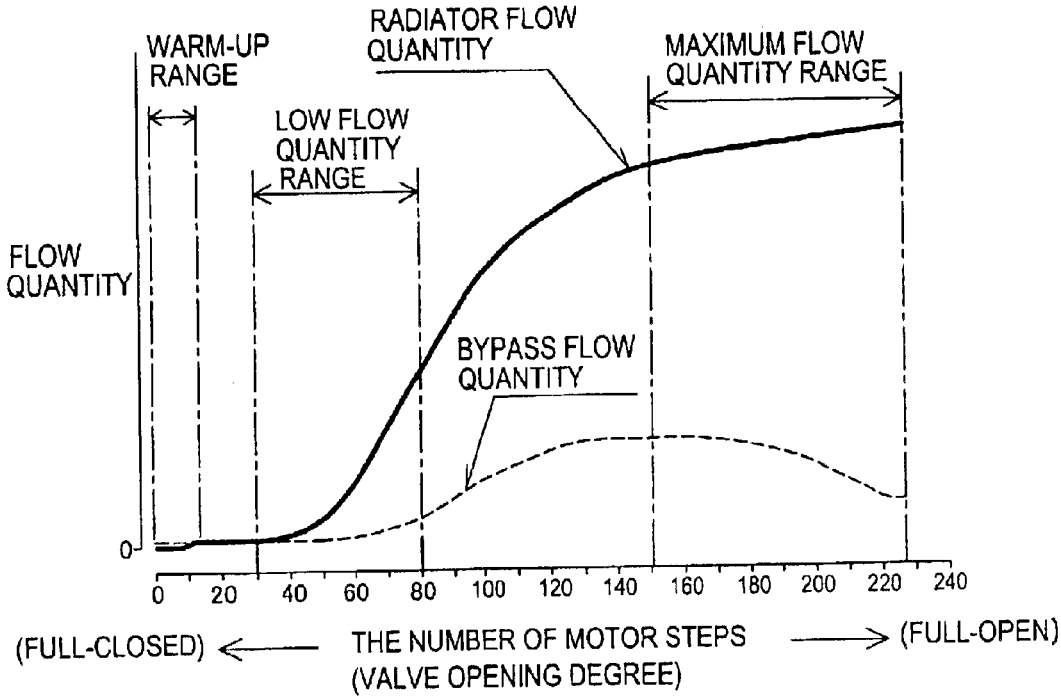

FIGS. 10A and 10B are graphs showing the flow quantity characteristic and the pressure characteristic of the flow control valve 1. In FIG. 10B, the lateral axis indicates the number of motor steps of the step motor 24 and the vertical axis indicates a flow quantity of the cooling water (including the radiator flow quantity and the bypass flow quantity). In FIG. 10A, the lateral axis indicates the number of motor steps of the step motor 24 and the vertical axis indicates the pressure of the radiator flow (hereinafter referred to as "radiator flow pressure") exerting on the radiator port 41 and the pressure of the bypass flow (hereinafter referred to as "bypass flow pressure") exerting on the bypass port 33. In this case, the number of motor steps in the lateral axis corresponds to the opening degree of the valve 20 (valve opening degree). The number of motor steps of "0" corresponds to a "full closed state" of the valve 20 and the number of motor steps of "about 230" corresponds to a "full open state" of the valve 20. That is, in the present embodiment, the radiator flow quantity and the bypass flow quantity are expressed in ranges in relation to the valve opening degree representing a displaced amount of the valve 20.

The radiator flow quantity shows a tendency to increase as shown in FIG. 10B as the displacement amount of the valve 20 (namely, the valve opening degree) increases. This characteristic is determined by the radiator-side opening degree from the full closed state of the first valve body 31 shown in FIG. 7 to the full open state shown in FIG. 9 via the half-open state shown in FIG. 8.

The bypass flow quantity shows an increase and a decrease as shown in FIG. 10B as the displacement amount of the valve 20 (namely, the valve opening degree) increases. This characteristic is determined by the bypass-side opening degree from the full closed state of the second valve body 32 shown in FIG. 7 to the full closed state shown in FIG. 9 via the half-open state shown in FIG. 8.

The above flow quantity characteristic is determined so that the bypass flow quantity becomes slightly larger than the radiator flow quantity in the range where the radiator flow quantity is approximately zero (corresponding to the "warm-up range" in FIG. 10B), while the bypass flow quantity is equal to or smaller than the radiator flow quantity. Particularly, in FIG. 10B, the flow quantity characteristic in the "low flow quantity range" where the number of motor steps becomes "30 to 80" is determined such that the bypass flow quantity is smaller than the radiator flow quantity, and the radiator flow quantity almost linearly increases rapidly while the bypass flow quantity substantially remains unchanged.

The above flow characteristic in the "warm-up range" corresponds to the characteristic determined by the first valve body 31 that is moved from the full closed state shown in FIG. 7 into a slightly open state. More specifically, this flow characteristic is obtained while the cylindrical part 31*c* of the first valve body 31 is in contact with the circumferential part 35*b* of the first valve seat 35. In this range, the radiator flow quantity is maintained at zero while the cylindrical part 31*c* is moved in contact with the circumferential part 35*b*. During this period of time, on the other hand, the upper measuring part 32*a* of the second valve body 32 is in contact with the circumferential part 36*b* of the second valve seat 36. In this contact state, a fine clearance previously provided between the upper measuring part 32*a* and the circumferential part 36*b* steadily provides the bypass flow of a corresponding small quantity. Accordingly, the bypass flow is permitted to flow at a quantity slightly larger than the radiator flow by the small bypass flow quantity allowed through the fine clearance.

The flow characteristic of the radiator flow quantity in the "low flow quantity range" is obtained during a period from the time when the cylindrical part 31*c* of the first valve body 31 begins to be separated from the circumferential part 35*b* of the first valve seat 35 until the time when the cylindrical part 31*c* reaches a half-open state shown in FIG. 8, passing through the tapered part 35*c* of the first valve seat 35. In this range, as the cylindrical part 31*c* comes through and off the tapered part 35*c*, the radiator flow quantity substantially linearly increases. In almost all this range, the upper measuring part 32*a* of the second valve body 32 is in the vicinity of the circumferential part 36*b* of the second valve seat 36, so that the fine clearance between the upper measuring part 32*a* and the circumferential part 36*b* is maintained. Accordingly, the bypass flow quantity does not essentially increase.

In FIG. 10B, in the larger range than the "low flow quantity range", up to the full open state, the radiator flow quantity increases in a quadratic curve as the valve opening degree increases to reach the "maximum flow quantity range". This flow characteristic of the radiator flow is obtained when the measuring part 31*a* of the first valve body 31 changes from the half-open state shown in FIG. 8 to the full open state shown in FIG. 9 while the measuring part 31*a* comes off the first valve seat 35 and the second valve body 32 comes close to the first valve seat 35. The bypass flow quantity, on the other hand, slowly increases and slowly decreases while the valve opening degree increases. This bypass flow characteristic is obtained when the second valve body 32 changes from the state shown in FIG. 8 to the state shown in FIG. 9 while the upper measuring part 32*a* comes off the second valve seat 36, whereas the lower measuring part 32*b* comes close to the second valve body 32. It is to be noted that the bypass flow does not become zero even when the second valve body 32 is brought into the state shown in FIG. 9. This is because a slight clearance is provided between the lower measuring part 32*b* of the second valve body 32 and the circumferential part 36*b* of the second valve seat 36, thereby producing the bypass flow of a quantity corresponding to the clearance.

According to the flow control valve 1 described above in the present embodiment, which is used in the engine cooling system shown in FIG. 6, the ECU 11 determines a valve opening degree according to an operating state of the engine 2 to control the step motor 24 of the flow control valve 1. Thus, the flow characteristic can be obtained in correspondence with the determined valve opening degree.

To start the engine 2 from a cold state, for instance, the ECU 11 controls the step motor 24 at a required number of motor steps to selectively use the "warm-up range" of the above mentioned flow characteristic. In this case, the radiator flow quantity becomes practically zero, so that the cooling water flowing through the cooling water passage 3 in the engine 2 does not pass through the radiator 8, not radiating heat, and the bypass flow of a very small quantity is provided. That is, the bypass flow quantity is slightly larger than the radiator flow quantity in the "warm-up range" where the radiator flow quantity is practically zero. The cooling water flowing out of the engine 2 is therefore permitted to return to the water pump 5 by the very small quantity of the bypass flow and circulate through the engine 2 again even where no circulation including heat radiation by the radiator 8 is caused. Accordingly, the cooling water of the very small quantity is permitted to flow through the passage 3 and the first water temperature sensor 12 detects the engine outlet water temperature reflecting the current temperature of the engine 2.

Supposing that the bypass flow quantity is set at zero, the cooling water is not permitted to flow through the cooling water passage 3. As a result, the first water temperature sensor 12 could not detect an appropriate engine outlet water temperature reflecting the current temperature of the engine 2, but would detect a temperature of the cooling water staying in the vicinity of the outlet of the passage 3, which is an inappropriate temperature for the engine outlet water temperature. In the present embodiment, the above disadvantages can be avoided and the engine 2 can be efficiently warmed up as needed in the cold state. Thus, the temperature of the engine 2 can be properly reflected in the control of the flow control valve 1.

Furthermore, the ECU 11 controls the step motor 24 at a required number of motor steps to selectively use a range between the "warm-up range" and the "maximum flow quantity range" in the flow characteristic shown in FIG. 10B, thereby controlling the cooling degree of the engine 2. In this case, the cooling water flowing through the passage 3 is permitted to flow in both the radiator passage 6 and the bypass passage 7. The first water temperature sensor 12 thus detects an appropriate temperature of the cooling water at the engine outlet, reflecting the temperature of the engine 2. The second water temperature sensor 13, on the other hand, detects an appropriate temperature of the cooling water at the radiator outlet, reflecting the radiating state of the radiator 8. To ensure the radiator flow quantity required for cooling the engine 2, furthermore, the flow control valve 1 can be appropriately controlled based on the engine outlet water temperature and the radiator outlet water temperature both detected in the above manner. In the range between the "warm-up range" and the "maximum flow quantity range", the radiator flow quantity changes in an almost secondary curve with respect to the number of motor steps (i.e., the valve opening degree). Thus, the ECU 11 can smoothly perform feedback control of the cooling water temperature to a target temperature.

During a high-load operation of the engine 2, the ECU 11 controls the step motor 24 of the valve 1 at a required number of motor steps in order to selectively use the "maximum flow quantity range" in the flow quantity characteristic shown in FIG. 10B. In this case, the radiator flow quantity becomes maximum, the circulation quantity of the cooling water circulating through the cooling water passage 3 and then passing through the radiator 8 becomes maximum, and thus the heat-radiating efficiency of the cooling water in the radiator 8 becomes maximum. Accordingly, the temperature rise of the cooling water can be suppressed to a minimum so that the engine 2 is cooled maximally.

In the flow control valve 1 in the present embodiment, meanwhile, the bypass flow quantity has a relatively larger influence on the pressure characteristic as compared with the radiator flow quantity. As shown in FIG. 10B, in the ranges other than the "warm-up range" where the radiator flow quantity becomes practically zero, the bypass flow quantity having the large influence on the pressure characteristic of the cooling water is equal to or smaller than the radiator flow quantity. Thus, a difference in pressure between the pressure of the radiator flow acting on the first valve body 31 (hereinafter referred to as "radiator flow pressure") and the pressure of the bypass flow acting on the second valve body 32 (hereinafter referred to as "bypass flow pressure") is reduced at every valve opening degrees as shown in FIG. 10A. The thrust produced by the pressure of the cooling water acting on the valve unit 20 is correspondingly reduced. This also reduces the thrust produced by the pressure of the cooling water which acts on the step motor 24 from the valve 20 through the joint 58 and the guide 57, so that the driving torque to be requested to the step motor 24 can be decreased by just that much. As a result, the step motor 24 can be downsized according to a reduction in driving torque (power), thereby achieving downsizing of the flow control valve 1. Accordingly, the mountability of the flow control valve 1 to the engine 2 can be enhanced.

According to the flow characteristic of the flow control valve 1 in the present embodiment, as shown in FIG. 10B, the radiator flow quantity is increased toward the maximum flow quantity in proportion to an increase in the displacement amount (the valve opening degree) of the valve 20. The bypass flow quantity is increased once and then decreased as the displacement amount of the valve 20 (the valve opening degree) is increased. Consequently, in the "maximum flow quantity range" where the radiator flow quantity becomes maximum, the bypass flow quantity is decreased. By this decreased bypass flow quantity, the cooling water which circulates as a radiator flow is increased. During the high-load operation of the engine 2 which needs to be cooled maximally, the cooling water of the maximum flow quantity can be radiated in the radiator 8 to be cooled, thereby enhancing the cooling effect of the engine 2.

In the present embodiment, the engine block 2*a* constructing the engine 2 includes the housing 21, the pump passage 4, and the bypass passage 7. This configured engine block 2*a* is one of engines of an "internal bypass type" which causes cooling water to flow through the internally provided bypass passage 7. This type has currently been adopted in many engines.

As described above, according to the flow control valve 1 in the first embodiment, as shown in FIGS. 1 and 3 to 5, the housing 21 previously provided in the engine block 2*a* of the current "internal bypass type" can be utilized for holding the second body 23 to mount the flow control valve 1 in the engine block 2*a*. In this mounted state, the bypass port 33 of the second body 23 is communicated with the bypass passage 7 of the engine block 2*a*. Thus, the bypass flow quantity passing through the flow control valve 1 can be provided. The pump port 34 of the second body 23 is communicated with the pump passage 4 of the engine block 2*a*. Accordingly, the radiator flow quantity and the bypass flow quantity controlled by the flow control valve 1 are returned to the water pump 5 through the pump passage 4. In this way, the housing 21 of the engine block 2*a* can be used for mounting the flow control valve 1, which can avoid the need to change the shape of the engine block 2*a* and additionally provide external bypass pipe and others to the engine block 2*a* for the purpose of mounting the flow control valve 1. Consequently, the flow control valve 1 can be mounted in the engine 2 simply and inexpensively, and therefore, the cost of manufacturing the cooling system can be prevented from extremely rising.

[Second Embodiment]

Next, a second embodiment of a flow control valve embodying the present invention will be described with reference to the accompanying drawings. It is to be noted that like elements corresponding to those in the first embodiment are indicated by like numerals, and their explanations are omitted. This second embodiment is explained with a focus on different structures from those in the first embodiment.

Figure 11:
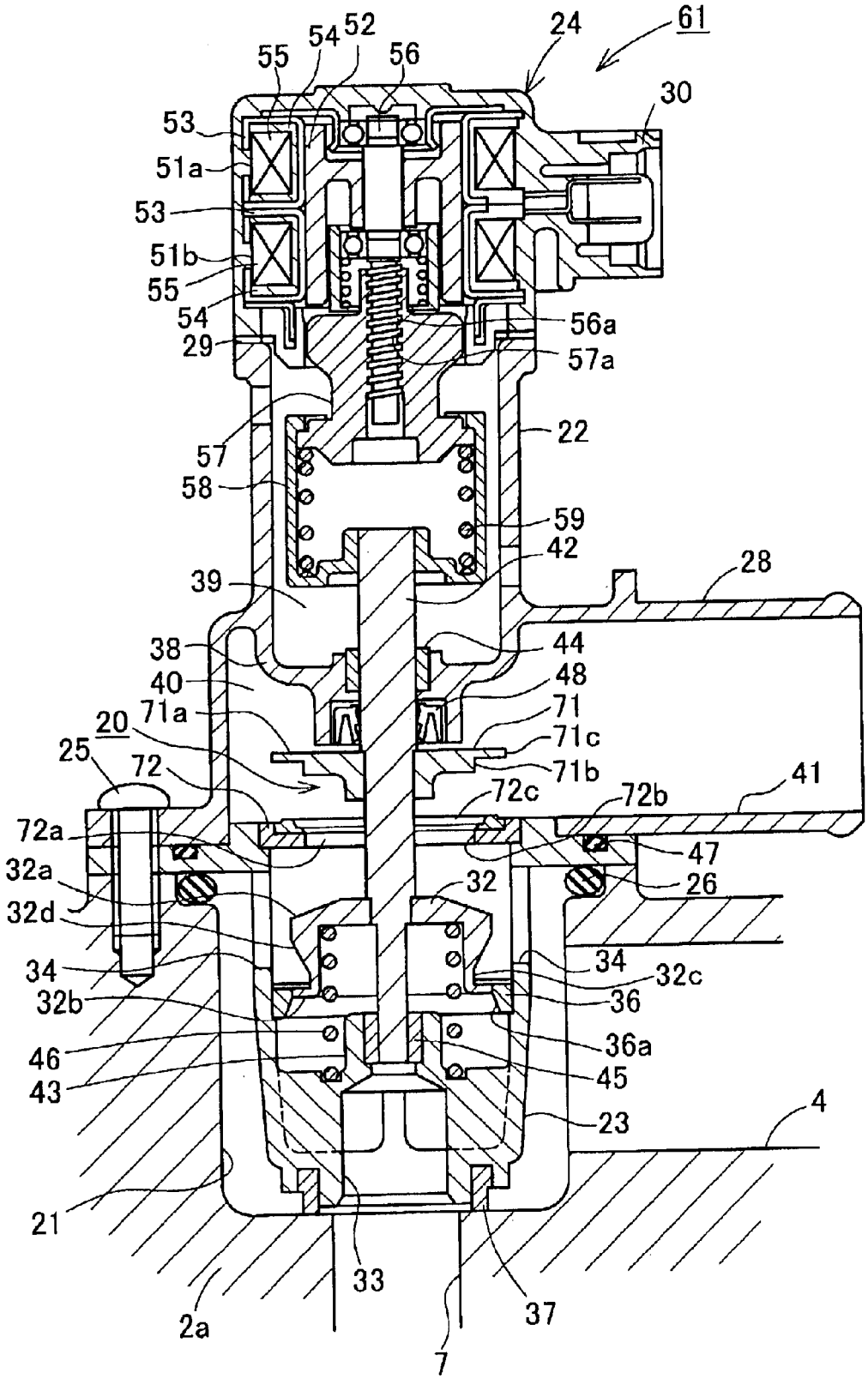
FIG. 11 is a longitudinal sectional view of a flow control valve in a second embodiment.

FIG. 11 is a longitudinal sectional view of a flow control valve 61 in the present embodiment. FIG. 11 is based on FIG. 3. This flow control valve 61 includes a first valve body 71 and a first valve seat 72 which differ from those of the flow control valve 1 in the first embodiment.

The first valve body 71 has a substantially short cylindrical shape including a flange-shaped measuring part 71*a* formed in the upper portion. The first valve body 71 does not include the maximum flow quantity limiting part 31*b* provided in the first valve body 31 in the first embodiment. In the present embodiment, the valve shaft 42 directly underneath the first valve body 71 has the same function as the maximum flow quantity limiting part 31*b*. The measuring part 71*a* of the first valve body 71 can be engaged in a valve opening 72*a* of the first valve seat 72. To be specific, the measuring part 71*a* includes a cylindrical part 71*b* and a large-diameter part 71*c* having the outer diameter than that of the cylindrical part 71*b*. The valve opening 72*a* of the first valve body 72 includes a circumferential part 72*b* whose surface conforms to the outer surface of the cylindrical part 71*b* of the first valve body 71 and a sealing part 72*c* whose surface conforms to the outer surface of the large-diameter part 71*c*. The sealing part 72*c* is provided by baking rubber on a substrate forming the first valve seat 72. When the first valve body 71 is moved up and down integrally with the valve shaft 42, the radiator-side opening degree defined by a clearance between the valve body 71 and the valve seat 72 is changed. FIG. 11 shows the valve 20 in a full open state for the radiator-side opening degree. In a full closed state for the radiator-side opening degree, the cylindrical part 71*b* of the first valve body 71 is engaged in the circumferential part 72*b* of the first valve seat 72 and the large-diameter part 71*c* of the first valve body 71 is brought into close contact with the sealing part 72*c* of the first valve seat 72.

According to the flow control valve 61 in the second embodiment, the same effects as those by the flow control valve 1 in the first embodiment can be obtained. In addition, the maximum flow quantity of the radiator flow can be more increased as compared with in the first embodiment by the quantity resulting from that the first valve body 71 includes no maximum flow quantity limiting part. Furthermore, the first valve body 71 is provided with the large-diameter part 71*c* and the first valve seat 72 is provided with the sealing part 72*c* which can come into close contact with the large-diameter part 71*c*, so that the sealing ability against the cooling water can be enhanced when the radiator-side opening degree is brought into the full closed state.

The present invention may be embodied in other specific forms without departing from the spirit or essential characteristics thereof.

In the above embodiments, the flow quantity characteristics of the flow control valves 1 and 61 are each determined so that the radiator flow quantity increases as the displacement amount of the valve 20 increases, and the bypass flow quantity increases and decreases as the displacement amount of the valve 20 increases. The increase and decrease relation between the radiator flow quantity and the bypass flow quantity is not limited to the above mentioned and may be changed as appropriate.

Although the step motor 24 is used as an actuator in the above embodiments, different types of actuators such as a DC motor and a linear solenoid may be used.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A flow control valve which is used in a cooling system of a water cooling type for cooling an engine by circulating cooling water by a water pump and radiating heat of the cooling water by a radiator;

the cooling system including a cooling water passage provided in the engine, a radiator flow passage for permitting the cooling water flowing out of the cooling water passage to return to the water pump through the radiator, a bypass flow passage for permitting the cooling water flowing out of the cooling water passage to directly return to the water pump without passing through the radiator, and an electronic control device for controlling the flow control valve, the radiator flow passage and the bypass flow passage being connected to the flow control valve at a position upstream from the water pump;

the flow control valve including a first valve body and a first valve seat for controlling a radiator flow quantity corresponding to a flow quantity of the cooling water flowing in the radiator passage, a second valve body and a second valve seat for controlling a bypass flow quantity corresponding to a flow quantity of the cooling water flowing in the bypass passage, and an actuator for displacing the first and second valve bodies integrally as one valve;

the electronic control device for controlling the actuator to displace the valve, thereby regulating the radiator flow quantity and the bypass flow quantity to control a temperature of the cooling water to a target temperature;

the radiator flow quantity and the bypass flow quantity are defined in terms of ranges in relation to the displacement amount of the valve so that each structure of the first valve body and the first valve seat and each structure of the second valve body and the second valve seat are determined to have a flow quantity characteristic that the bypass flow quantity is slightly larger than the radiator flow quantity in a range where the radiator flow quantity becomes practically zero and, in other ranges, the bypass flow quantity is equal to or lower than the radiator flow quantity.

2. The flow control valve according to claim 1, wherein the first valve seat includes a valve opening, the first valve body has a substantially cylindrical shape including a flange-shaped measuring part formed in an upper portion, the measuring part being conformable to the valve opening of the first valve seat, a radiator-side opening degree defined by a clearance between the first valve body and the first valve seat is changed when the first valve body is moved up and down, the second valve seat includes a valve opening, the second valve body has a substantially cylindrical shape having an approximately same diameter as that of the measuring part of the first valve body, the second valve body including an upper measuring part formed in an upper portion and a maximum flow quantity limiting part formed in a middle portion, the upper measuring part being conformable to the valve opening of the second valve seat, and a fine clearance is provided between the upper measuring part and the valve opening when the upper measuring part is engaged in the valve opening, and a bypass-side opening degree is defined between the upper measuring part of the second valve body and the second valve seat and is changed when the second valve body is moved up and down as a unit with the first valve body.

3. The flow control valve according to claim 2, wherein the measuring part of the first valve body includes a cylindrical part and a large-diameter part having a larger diameter than that of the cylindrical part, the valve opening of the first valve seat includes a first sealing part which is conformable to the cylindrical part and a second sealing part which is conformable to the large-diameter part, the valve opening of the second valve seat includes a circumferential part which is conformable to the upper measuring part of the second valve body, and the fine clearance is provided between the upper measuring part of the second valve body and the circumferential part of the second valve seat while the cylindrical part of the first valve body is moved in contact with the first sealing part of the first valve seat.

4. The flow control valve according to claim 1, further including a body, a boss and a partition wall provided in the body, and a single valve shaft supported in the boss and the partition wall through a bearing so that the valve shaft is movable in a thrust direction, and wherein the first and second valve bodies are fixed one above the other onto the valve shaft to construct the valve, and the valve shaft is connected to the actuator.

5. The flow control valve according to claim 4, further including a back spring disposed between the second valve body and the boss, wherein the back spring presses the second valve body as well as the first valve body by a predetermined urging force to urge the first valve body in a valve opening direction, the urging force being determined to a minimum when output power of the actuator is minimized.

6. The flow control valve according to claim 1, wherein the engine includes an engine block, the engine block includes a thermostat housing for mounting a thermostat in the engine block, a pump passage for permitting the cooling water to flow from the thermostat housing to the water pump, and a bypass passage for permitting the cooling water to flow in the thermostat housing to return to the water pump without passing through the radiator, and the flow control valve includes a joint body mounted in the thermostat housing, the joint body including a pump port connectable in communication with the pump passage and a bypass port connectable in communication with the bypass passage.

7. A flow control valve which is used in a cooling system of a water cooling type for cooling an engine by circulating cooling water by a water pump and radiating heat of the cooling water by a radiator;

the cooling system including a cooling water passage provided in the engine, a radiator flow passage for permitting the cooling water flowing out of the cooling water passage to return to the water pump through the radiator, a bypass flow passage for permitting the cooling water flowing out of the cooling water passage to directly return to the water pump without passing through the radiator, and an electronic control device for controlling the flow control valve, the radiator flow passage and the bypass flow passage being connected to the flow control valve at a position upstream from the water pump;

the flow control valve including a first valve body and a first valve seat for controlling a radiator flow quantity corresponding to a flow quantity of the cooling water flowing in the radiator passage, a second valve body and a second valve seat for controlling a bypass flow quantity corresponding to a flow quantity of the cooling water flowing in the bypass passage, and an actuator for displacing the first and second valve bodies integrally as one valve;

the electronic control device for controlling the actuator to displace the valve, thereby regulating the radiator flow quantity and the bypass flow quantity to control a temperature of the cooling water to a target temperature;

the radiator flow quantity and the bypass flow quantity are defined in terms of ranges in relation to the displacement amount of the valve so that each structure of the first valve body and the first valve seat and each structure of the second valve body and the second valve seat are determined to have a flow quantity characteristic that the radiator flow quantity increases with respect to an increase of displacement amount of the valve while the bypass flow quantity increases and decreases with respect to the increase of displacement amount of the valve, the bypass flow quantity is slightly larger than the radiator flow quantity in a range where the radiator flow quantity becomes practically zero and, in other ranges, the bypass flow quantity is equal to or lower than the radiator flow quantity.

8. The flow control valve according to claim 7, wherein the first valve seat includes a valve opening, the first valve body has a substantially cylindrical shape including a flange-shaped measuring part formed in an upper portion, the measuring part being conformable to the valve opening of the first valve seat, a radiator-side opening degree defined by a clearance between the first valve body and the first valve seat is changed when the first valve body is moved up and down, the second valve seat includes a valve opening, the second valve body has a substantially cylindrical shape having an approximately same diameter as that of the measuring part of the first valve body, the second valve body including an upper measuring part formed in an upper portion, a lower measuring part formed in a lower portion, a maximum flow quantity limiting part formed in a middle portion, and a flow quantity changing part formed between the upper measuring part and the maximum flow quantity limiting part, the upper and lower measuring parts each being conformable to the valve opening of the second valve seat, a bypass-side opening degree is defined between the second valve seat and each of the upper and lower measuring parts of the second valve body and is changed when the second valve body is moved up and down as a unit with the first valve body, and, the bypass-side opening degree increases from a full closed state of the second valve seat where the lower measuring part of the second valve body is engaged in the valve opening of the second valve seat to a full open state and decreases to the full closed state again while the second valve body is moved down from the full closed state, the lower measuring part is gradually moved away from the valve opening, the maximum fluid quantity limiting part of the second valve body passes through the valve opening of the second valve seat, and then the upper measuring part of the second valve body is moved to gradually come close to the valve opening of the second valve seat.

9. The flow control valve according to claim 8, wherein the measuring part of the first valve body includes a cylindrical part and a large-diameter part having a larger diameter than that of the cylindrical part, the valve opening of the first valve seat includes a first sealing part which is conformable to the cylindrical part and a second sealing part which is conformable to the large-diameter part, the valve opening of the second valve seat includes a circumferential part which is conformable to each of the upper and lower measuring parts of the second valve body, and the fine clearance is provided between the upper measuring part of the second valve body and the circumferential part of the second valve seat while the cylindrical part of the first valve body is moved in contact with the first sealing part of the first valve seat.

10. The flow control valve according to claim 7, further including a body, a boss and a partition wall provided in the body, and a single valve shaft supported in the boss and the partition wall through a bearing so that the valve shaft is movable in a thrust direction, and wherein the first and second valve bodies are fixed one above the other onto the valve shaft to construct the valve, and the valve shaft is connected to the actuator.

11. The flow control valve according to claim 10, further including a back spring disposed between the second valve body and the boss, wherein the back spring presses the second valve body as well as the first valve body by a predetermined urging force to urge the first valve body in a valve opening direction, the urging force being determined to a minimum when output power of the actuator is minimized.

12. The flow control valve according to claim 7, wherein the engine includes an engine block, the engine block includes a thermostat housing for mounting a thermostat in the engine block, a pump passage for permitting the cooling water to flow from the thermostat housing to the water pump, and a bypass passage for permitting the cooling water to flow in the thermostat housing to return to the water pump without passing through the radiator, and the flow control valve includes a joint body mounted in the thermostat housing, the joint body including a pump port connectable in communication with the pump passage and a bypass port connectable in communication with the bypass passage.

* * * * *